US005378078A

United States Patent [19]

Lewis et al.

[11] Patent Number: 5,378,078

[45] Date of Patent: Jan. 3, 1995

[54] MANHOLE COVER

[76] Inventors: Michael E. Lewis; Richard C. Lewis, both of 1555 Copper Hill Pkwy., Santa Rosa, Calif. 95403; Rodney E. Schapel, P.O. Box 60039, Reno, Nev. 89506

[21] Appl. No.: 961,147

[22] Filed: Oct. 15, 1992

Related U.S. Application Data

[63] Continuation-in-part of Ser. No. 777,098, Oct. 15, 1991, abandoned.

[51] Int. Cl.[6] ..... E02A 29/14

[52] U.S. Cl. ..... 404/25; 52/19

[58] Field of Search ..... 404/25, 26; 52/19, 20; 137/364, 371; 220/453, 523, DIG. 23

[56] References Cited

U.S. PATENT DOCUMENTS 4,662,777 5/1987 Newton ..... 404/25

4,726,707 2/1988 Newton ..... 404/25

*Primary Examiner*—Ramon S. Britts

*Assistant Examiner*—James A. Lisehora

*Attorney, Agent, or Firm*—Larry D. Johnson

[57] ABSTRACT

The improved manhole cover of this invention provides a strong yet lightweight access cover structure made from a series of radially staggered ply layers bonded above and below a homogenous frusto-conical core portion with resin, each ply layer made from an array of radially staggered unidirectional fiber tape.

6 Claims, 2 Drawing Sheets

MANHOLE COVER

This application is a Continuation-in-Part of co-pending application Serial No. 07/777,098, filed Oct. 15, 1991, abandoned.

BACKGROUND OF THE INVENTION

1. Field of the Invention

This invention relates generally to removable manhole covers and related structures, and more specifically to an improved manhole cover article and its method of manufacture.

2. Description of the Prior Art

Manhole covers are well known, and are typically used as removable access covers or hatches to underground equipment, utility vaults or shafts. Manhole covers are generally supported only at their peripheral edge by a cover frame or ring, and are preferably round (disc-like) in shape (to prevent the cover from falling through the ring). Traditionally, manhole covers have been manufactured from steel or other strong, rigid materials, chiefly so that they will be able to withstand the significant loads that may be applied to their top surface after installation (e.g., vehicular traffic). However, manhole covers made from such materials are necessarily very heavy, and therefore not easily manipulated and removed for user access to the covered volume.

SUMMARY OF THE INVENTION

The improved manhole cover of this invention provides a strong yet lightweight access cover structure made from a series of radially staggered ply layers bonded above and below a homogenous frusto-conical core portion with resin, each ply layer made from an array of radially staggered unidirectional fiber tape.

The composite manhole cover is manufactured by a closed molded vacuum/injection system, and uses a cored construction method (e.g., composite or balsa core material). The resin system used exhibits far superior physical properties over traditional polyester fiberglass, and has excellent impact, corrosion and ultraviolet properties. The resins combine the best features of polyester and polyurethane technologies.

Multiple ply layers (e.g., 5–16 ply layers above the core and 7–24 ply layers below the frusto-conical core) each made up of the unidirectional fiber arrays radiate from the center at exact radials to produce the strongest, stiffest and lightest assembly available. This allows for the strongest part at the least weight.

DETAILED DESCRIPTION OF A PREFERRED EMBODIMENT

Figure 1:
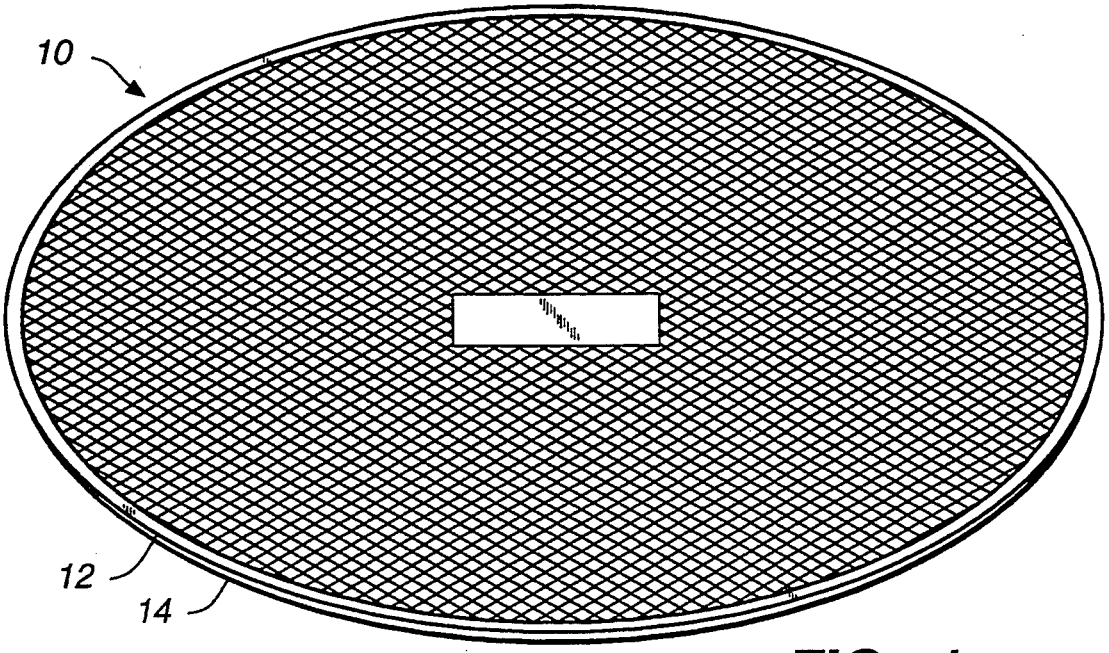
FIG. 1 is a top perspective view of an improved manhole cover of this invention, illustrating a typical top surface grid pattern.

FIG. 1 is a top perspective view of an improved manhole cover 10 of this invention, illustrating a typical top surface grid pattern 12. The manhole cover is preferably manufactured in the traditional round (circular) shape, and when installed is supported in place on its peripheral edge 14 by a ring structure (not illustrated).

Figure 2:
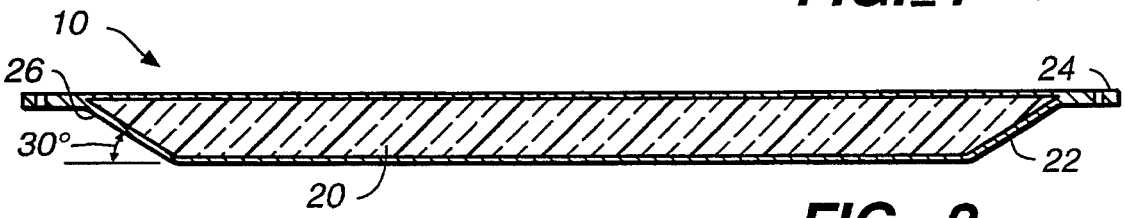
FIG. 2 is a side elevation cross-sectional view of an improved manhole cover of this invention, illustrating its generally frusto-conical core portion and body portion, and generally flat upper flange portion.

FIG. 2 is a side elevation cross-sectional view of an improved manhole cover 10 of this invention, illustrating its generally frusto-conical core portion 20 and body portion 22, and generally flat upper flange portion 34. Core portion 20 preferably bears an included angle 26 in the range of twenty to forty degrees, with a calculated ideal angle of approximately thirty degrees. It has been determined that such an angle yields desirable I-beam characteristics to the structure, rendering it both lighter and stronger than homogenous covers. Body portion 22 is formed by bonding ply layers both above and below the core portion, and thus replicates this desired angle.

Figure 3A:
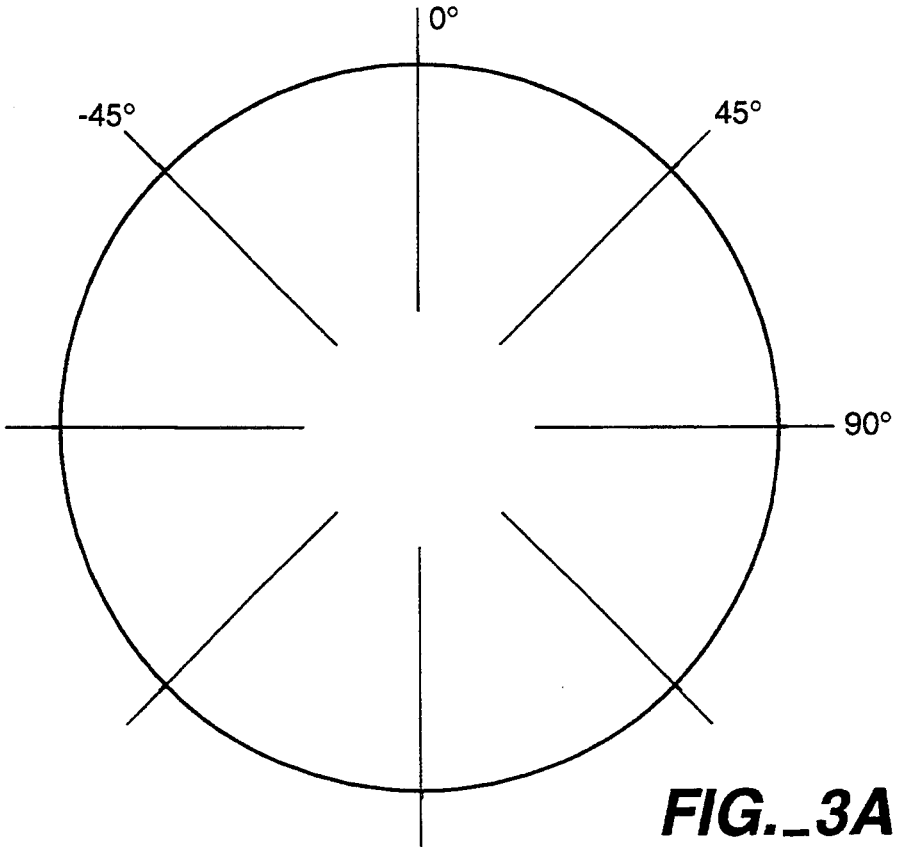
FIGS. 3A and 3B are diagrammatic views illustrating two alternate radial orientations for the staggered array of unidirectional fiber tape used to construct a single ply layer for the improved manhole cover of this invention.
Figure 3B:
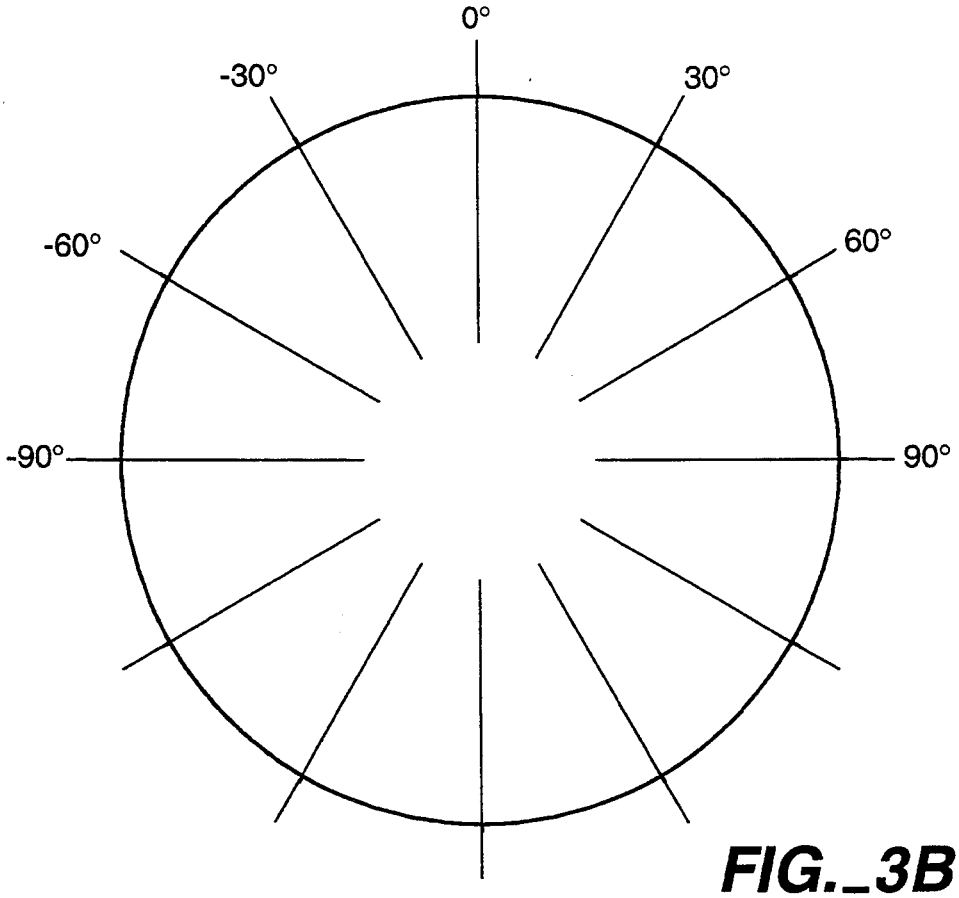

FIGS. 3A and 3B are diagrammatic views illustrating two alternate radial orientations for the staggered array of unidirectional fiber tape used to construct a single ply layer for the improved manhole cover of this invention.

FIG. 3A illustrates a "forty-five degree array", wherein the first piece of unidirectional fiber tape is laid down and defines zero degrees; a second piece of unidirectional fiber tape is laid down upon the first such that the fiber is oriented minus forty-five degrees relative to the first piece; a third piece is laid down upon the second piece such that the fiber is oriented ninety degrees relative to the first piece, and so on according to the following formula until a desired thickness is reached:

zero degrees, minus forty-five degrees, ninety degrees, plus forty-five degrees, zero degrees, and so forth.

FIG. 3B illustrates a "thirty degree array", where the unidirectional fiberglass tape is laid down as follows:

zero degrees, ninety degrees, plus thirty degrees, minus sixty degrees, minus thirty degrees, and finally plus sixty degrees, to generate a single ply.

These plys may then themselves be laid down above and below the frusto-conical core according to the following formula:

a first ply defines zero degrees;

a second ply is rotated plus ten degrees relative to the first ply;

a third ply is rotated plus twenty degrees relative to the first ply; and subsequent plys are each rotated an additional five degrees relative to the first ply until the desired thickness is achieved.

Non-directional glass mat may be used as the very top and bottom layers, before bonding.

Figure 4:
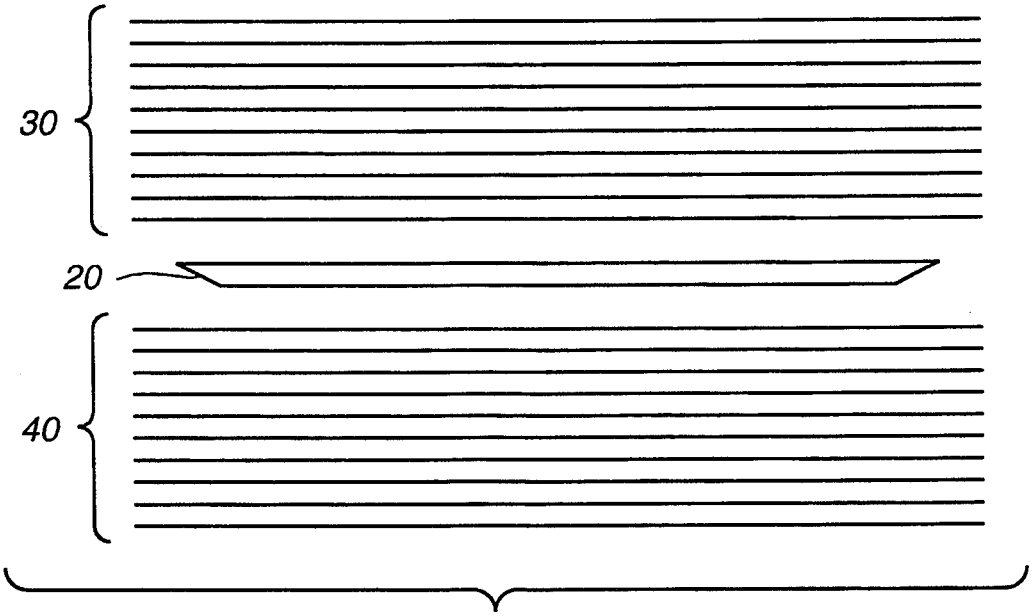
FIG. 4 is an exploded side elevation cross-sectional view illustrating the homogenous central core and series of upper and lower ply layers of the improved manhole cover of this invention.

FIG. 4 is an exploded side elevation cross-sectional view illustrating the homogenous central core 20 and series of upper and lower ply layers 30, 40 of the improved manhole cover of this invention. Any number of ply layers (e.g., five to sixteen upper ply layers 30, seven to twenty-four lower ply layers 40) may of course be used, depending upon the ultimate thickness desired or required. These ply layers are preferably radially staggered relative to one another, as described supra.

The composite manhole cover has been engineered to exceed the Department of Hwy-20 rating by over 100%. Primary tests for deflection have surpassed these computer specifications. The 36" composite cover weighs approximately 45 lbs. (the 30", 42" and 48" are relative). The deflection at a 65,000 lbs/in load is less than 0.35 in. Attesting to the superior fatigue qualities of composite, after 1 million cycles of loading at H-20 and unloading every ½ second the composite manhole cover exhibited no indication of failure or degradation.

Preliminary test data is as follows:

A manhole cover was center loaded and supported around its outer circumference. Load was applied through a 9" $\phi$ steel load platen with and without a rubber pad. The crosshead movement of the test machine was used as the deflection measurement. Load-deflection curves were recorded for loadings to 23,000 lbs and 35,000 lbs. The slope of these load-deflection curves was taken at the high load end or more linear portion of the curves. The initial sway-back in the curves is not believed to be actual part response, but rather the seating of the supporting collar on the numerous spacers. Two different load rates were used in an attempt to simulate a truck driving over the cover, resulting in an instantaneous loading. However, only 200,000–250,000 lbs/min (3,000–4,000 lbs/sec) could be achieved in this particular test machine which is substantially lower than the load rate applied by running over the cover. No indication of failure or degradation in the part was evident during all loadings including loadings to 35,000 lbs (50% over requirement). Performance was good and predictable using classical beam theory closed form solutions.

| Test | Load Deflection Curve | Deflection at Max Load |
|---|---|---|
| Loadings to 23,000 lbs. | 65,700 lbs/in. | .35 in. |
| Loadings to 35,000 lbs. | 66,700 lbs/in. | .54 in. |

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A method for manufacturing a manhole cover comprising the steps of:

providing a homogenous frusto-conical core portion having an included angle of between twenty degrees and forty degrees;

providing a ply layer comprising a plurality of unidirectional fiber tape pieces each having a radial orientation, the orientation of each piece generally offset relative to the orientation of the adjacent piece; and bonding a plurality of said ply layers above and below said frusto-conical core portion.

2. The method for manufacturing a manhole cover of claim 1 further including the step of:

providing a homogenous frusto-conical core portion having an included angle of thirty degrees.

3. The method for manufacturing a manhole cover of claim 1 further including the step of:

orienting said unidirectional fiber tape pieces such that each is offset generally forty-five degrees relative to adjacent pieces within said ply layer.

4. The method for manufacturing a manhole cover of claim 1 further including the step of:

orienting said unidirectional fiber tape pieces according to the following formula:

zero degrees, plus ninety degrees, plus thirty degrees, minus sixty degrees, minus thirty degrees, plus sixty degrees.

5. The method for manufacturing a manhole cover of claim 1 further including the step of:

providing each ply layer with a radial orientation, and bonding each of said ply layers above and below said frusto-conical core portion so that each ply layer is generally radially offset relative to the adjacent ply layer.

6. The method for manufacturing a manhole cover of claim 5 further including the step of:

orienting said ply layers to be radially offset by at least five degrees relative to adjacent ply layers.

* * * * *